US006729311B2

(12) United States Patent
Auernhammer et al.

(10) Patent No.: US 6,729,311 B2
(45) Date of Patent: May 4, 2004

(54) AERATION AND DEAERATION DEVICE FOR THE FUEL TANK OF AN INTERNAL COMBUSTION ENGINE

(75) Inventors: Helmut Auernhammer, Höttingen (DE); Dirk Bartz, Stuttgart (DE); Horst Hauke, Waiblingen (DE); Ivano Morgillo, Bieringen (DE); Hagen Zelssmann, Herrenberg (DE)

(73) Assignee: Mahle Filtersysteme GmbH, Stuttgart (DE)

( * ) Notice: Subject to any disclaimer, the term of this patent is extended or adjusted under 35 U.S.C. 154(b) by 47 days.

(21) Appl. No.: 10/182,809

(22) PCT Filed: Dec. 1, 2001

(86) PCT No.: PCT/DE01/04553

§ 371 (c)(1),
(2), (4) Date: Aug. 1, 2002

(87) PCT Pub. No.: WO02/46597

PCT Pub. Date: Jun. 13, 2002

(65) Prior Publication Data

US 2003/0000505 A1 Jan. 2, 2003

(30) Foreign Application Priority Data

Dec. 4, 2000 (DE) ..... 100 60 350

(51) Int. Cl.[7] ..... F02M 33/04
(52) U.S. Cl. ..... 123/519; 123/520
(58) Field of Search ..... 123/516, 518, 123/519, 520

(56) References Cited

U.S. PATENT DOCUMENTS 5,186,153 A * 2/1993 Steinbrenner et al. ..... 123/519
5,239,824 A 8/1993 Matsumoto
5,562,757 A 10/1996 Brun et al.

(List continued on next page.)

FOREIGN PATENT DOCUMENTS

DE 19509310 9/1996
DE 19650 517 6/1998

(List continued on next page.)

OTHER PUBLICATIONS

Patent Abstracts of Japan vol. 1998, No. 02, Jan. 30, 1998 & JP 09 268952 A (Suzuki Motor Corp), Oct. 14, 1997.

*Primary Examiner*—Thomas N. Moulis
(74) *Attorney, Agent, or Firm*—Collard & Roe, P.C.

(57) ABSTRACT

An aeration and deaeration device for the fuel tank (1) of an internal combustion engine (6) in which the aeration and deaeration are performed through an adsorption filter, the adsorption filter can be regenerated by backwashing with atmospheric air, the backwashing air is sent to the air intake area of the internal combustion engine, the composition of the backwashing air is determined and taken into account in control of the combustion process taking place inside the engine, should permit backwashing of the adsorption filter which has an influence on the composition of the engine exhaust gas. To this end, such a device is characterized by the following features: a sensor (9) which detects selected substance data and/or state data on the purging air is provided in a purging air line (5) carrying purging air into the intake area of an internal combustion engine (6), the area of the purging air line (5) containing the sensor (9) can be switched together with the interior of the adsorption filter (4) as a forced flow circulation line, for turning the circulation line on and off, a 3/2-way valve (8) is situated in the purging air line (5) downstream from the sensor (9), its one outlet leading to the outside of the circulation line and its other outlet leading back to the adsorption filter (4) through a bypass line (7) running parallel to the purging air line (5).

8 Claims, 1 Drawing Sheet

U.S. PATENT DOCUMENTS

Figure 1:
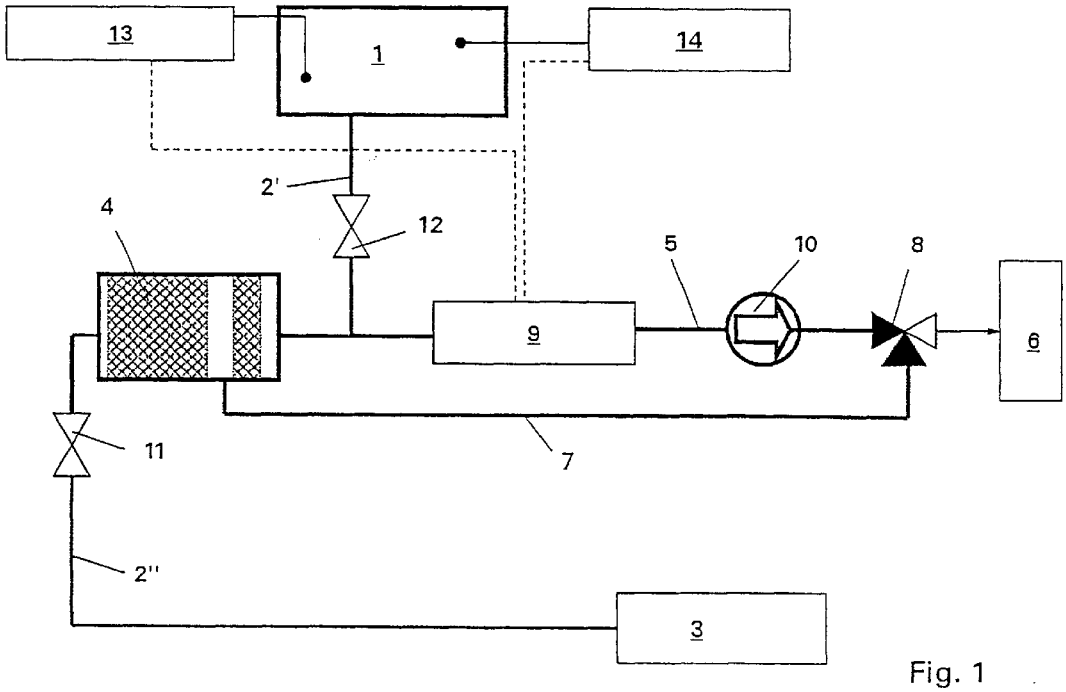

| | | | | | |
|---|---|---|---|---|---|
| 5,596,972 | A | | 1/1997 | Sultan et al. | |
| 5,875,765 | A | | 3/1999 | Norton | |
| 5,881,700 | A | | 3/1999 | Gras et al. | |
| 5,918,580 | A | * | 7/1999 | Hennrich et al. | 123/520 |
| 5,957,113 | A | | 9/1999 | Masaki et al. | |
| 6,182,502 | B1 | * | 2/2001 | Schwegler et al. | 123/520 |
| 6,237,575 | B1 | * | 5/2001 | Lampert et al. | 123/520 |
| 2001/0052292 | A1 | * | 12/2001 | Ito | 123/519 |

FOREIGN PATENT DOCUMENTS

| | | |
|---|---|---|
| DE | 19813321 | 10/1999 |
| DE | 199 22 302 | 11/2000 |
| EP | 0536001 | 4/1993 |
| EP | 0604027 | 6/1994 |
| GB | 2349177 | 10/2000 |
| GB | 2354800 | 4/2001 |

* cited by examiner

AERATION AND DEAERATION DEVICE FOR THE FUEL TANK OF AN INTERNAL COMBUSTION ENGINE

CROSS REFERENCE TO RELATED APPLICATIONS

Applicants claim priority under 35 U.S.C. §119 of GERMAN Application No. 100 60 350.5 filed on Dec. 4, 2000. Applicants also claim priority under 35 U.S.C. §365 of PCT/DE01/04553 filed on Dec. 1, 2001. The international application under PCT article 21(2) was not published in English.

This invention relates to an aeration and deaeration device for the fuel tank of an internal combustion engine according to the preamble of patent claim 1.

Such a device is known from German Patent 198 13 321 A1.

This invention relates to the problem of determining the composition of the backwashing air more easily and in particular to be able to take this into account with regard to changes during backwashing operation. It should also be possible in engine control to take into account the volume flow and temperature in addition to the composition of the backwashing air.

This problem is solved by an embodiment of a generic device according to the characterizing features of patent claim 1.

Expedient and advantageous embodiments are the object of the subclaims, which also concern methods executable using this device.

This invention is based essentially on the general idea of temporarily passing an air flow in circulation through the packing of the adsorption filter and thereby determine the loading state by means of a sensor mounted in the circulation. Regeneration of the adsorption filter by backwashing may be performed in this way as a function of the loading state determined previously. If, in circulating flow, the loading state detected on the adsorption filter is such that regeneration by backwashing is necessary or desirable, then the same sensor that detected the loading state of the adsorption filter in circulating flow continuously determines the composition of the fluid removed from the circulation line. The fluid leaving the circulation line, i.e., the loaded rinsing air, is sent in particular to the air intake area of the engine. Simultaneously with determination of the composition of the backwashing air, which in principle involves only the hydrocarbon content, the volume flow and temperature of the backwashing air can also be determined. All such state data detected can be used for engine control in supplying purging air into the air intake area of the engine, so that there is no influence on the combustion process that would interfere with the exhaust gas composition during the period when the purging air is being fed into the combustion process. The latter measures, however, are not necessary in this form if the purging air is added directly to the engine exhaust, for example, as is possible in a known manner.

To determine the loading of the adsorption filter with hydrocarbons, it may be sufficient that only a partial area of the filter guide is situated inside the flow circulation which is connected actively for the determination of loading.

The sensor which detects the substance properties and optionally the flow properties and state properties of the purging air may be integrated into an electronic device in which the data detected is processed (further) for forwarding to a central engine control. Sensors that detect the filling level and the pressure inside the tank, namely a pressure sensor and a filling level sensor, may be connected to this electronic device. Therefore, there is an extra electronic device which is separate from the central engine electronics and is connected only to it and may compile all the measurement and control data pertaining to the tank and its aeration and deaeration. This separate electronic device may be part of the adsorption filter, so that an easily handled adsorption filter module is created.

An exemplary embodiment, which is explained in greater detail below, is illustrated in the drawing; in this embodiment, the backwashing air is sent to the air intake area of the internal combustion engine.

The drawing includes only one figure, namely:

FIG. 1 a flow chart of an aeration and deaeration device of a fuel tank having a regenerable adsorption filter.

A fuel tank 1 is connected to the atmosphere via an aeration and deaeration device 2', 2" with a dust filter 3 connected in between. With partial area 2', the aeration and deaeration line coming from tank 1 opens into an adsorption filter 4 which is backwashable for regeneration. The connection between this filter 4 and the atmosphere is formed by area 2" of the aeration and deaeration line.

For backwashing filter 4 with air from the atmosphere, a purging air line 5 leads into the intake air area of an internal combustion engine 6. A bypass line 7 branches off from a flow area situated between the inlet and outlet openings of the aeration and deaeration line 2', 2", to the purging air line 5, which opens into a 3/2-way valve 8. A sensor 9 and a delivery pump 10 are situated between the 3/2-way valve 8 and the adsorption filter 4.

Cutoff valves 11 and 12 are provided in the individual areas 2' and 2" of the aeration and deaeration line.

The sensor 9 may be connected to a filling level sensor 13 which detects the filling level of the tank 1 and a pressure sensor 14 which detects the pressure inside the tank.

The device described above functions as follows.

Aeration and Deaeration Operation of the Fuel Tank

In deaeration and aeration operation of tank 1, the cutoff valves 11 and 12 are opened, so that fluid may flow through the adsorption filter 4 in both directions for aeration and deaeration.

Regeneration of the Adsorption Filter by Backwashing

The device described here makes it possible to make a backwashing depend on the degree of loading of filter 4 with hydrocarbons. To determine the degree of loading, a circulating air stream is passed through the filter 4 according to certain specifications, which may depend only on time. The flow paths of the air circulation are determined by the purging air line 5, the sensor 9, the delivery pump 10, the 3/2-way valve 8, the backwashing line 7 and a partial area of the packing of adsorption filter 4. To activate the circulating flow, the delivery pump 10 is turned on while the cutoff valves 11 and 12 are closed. With sensor 9, the hydrocarbon loading of the packing of the adsorption filter 4 may be determined.

If the device is operated so that backwashing is to be performed at a certain loading state of filter 4, then backwashing is initiated whenever a corresponding loading threshold value has been detected by the sensor 9. The backwashing is then initiated by switching the 3/2-way valve and opening the cutoff valve 11 after the state data on the purging air as measured by sensor 9 have already been sent to the central engine control. The state data on the rinsing air, namely in particular the hydrocarbon content, the volume flow and temperature, are sent through the sensor 9 to the central engine control during the entire purging air operation, so that changes of state in the engine control can be taken into account continuously.

In this way, it is possible to completely suppress an interfering influence of the purging air on the exhaust gas composition by taking into account the state data of the purging air during purging air operation with the help of the engine control.

Backwashing of the adsorption filter 4 can also be made dependent on the degree of tank filling by coupling the filling level data on tank 1 to the state data on the purging air detected in sensor 9 and relaying this data jointly to the central engine control. For example, it is fundamentally possible at a certain degree of emptying of tank 1 to perform backwashing of the filter 4 independently of the degree of loading of the filter.

With the device described here, it is also possible to perform a leakage test on tank 1 and its inlet and outlet lines, including the adsorption filter 4 by switching the 3/2-way valve to circulation flow, turning on the delivery pump 10, closing the cutoff valve 11 and opening the cutoff valve 12.

The sensor 9 may be part of an electronic device, which is also used to receive and process further the tank filling level data and pressure data, in addition to receiving and further processing of the state data on the purging air. This electronic device may be integrated into the housing of the filter 4 together with the valves 11 and 12 and the delivery pump 8 and the 3/2-way valve. Thus, even extremely short lines 5 and 7 are achieved through corresponding integration into the filter 4.

Essentially the circulation flow of the purging gas according to this invention is also suitable for the case in which the loading state of the adsorption filter is to be measured only as a function of certain time and/or state data in order to be able to determine the prerequisite for the required backwashing. Such a prerequisite may consist, for example, of exceeding a predetermined load limit value at which backwashing is to be performed. The backwashing air may be sent further in various ways, i.e., including directly into the exhaust gas, for example.

What is claimed is:

1. An aeration and deaeration device of the fuel tank (1) of an internal combustion engine (6) in which the aeration and deaeration are performed through an adsorption filter (4), the adsorption filter (4) can be regenerated by backwashing with atmospheric air, the backwashing air is added in particular to the air intake area of the internal combustion engine (6), the composition of the backwashing air is detected, and in the case of a supply to the air intake area of the internal combustion engine (6), this is taken into account in the control of the combustion process taking place inside the engine (6), characterized by the features a sensor (9) which detects selected substance and/or state data on the purging air is provided in a purging air line (5) carrying purging air into the intake area of an internal combustion engine (6), the area of the purging air line (5) containing the sensor (9) can be switched together with the interior of the adsorption filter (4) as a forced flow circulation line, for turning the circulation line on and off, a 3/2-way valve (8) is situated in the purging air line (5) downstream from the sensor (9), its one outlet leading to the outside of the circulation line and its other outlet leading back to the adsorption filter (4) through a bypass line (7) running parallel to the purging air line (5), with the circulation line turned on, the lines (2', 2") leading to the tank (1) and the atmosphere are blocked by the cutoff valves (11, 12).

2. The device according to claim 1, characterized in that a delivery pump (10) is provided in the purging air line (5) upstream from the 3/2-way valve.

3. The device according to claim 1, characterized in that the bypass line (7) opens into a flow area of the adsorption filter (4) situated between the inflow and outflow sides, so that only one corresponding partial area of the adsorption filter packing facing the outflow side facing the sensor (9) is situated in the circulating flow path.

4. The device according to claim 1, characterized in that the sensor (9) detects the hydrocarbon content, the volume flow and the temperature of the backwashing air.

5. The device according to claim 1, characterized in that the sensor (9) is integrated into an electronic device in which the values detected by this sensor (9) are processed and relayed to a central engine control.

6. The device according to claim 1, characterized in that the electronic device, including the sensor (9), is connected to a pressure and/or filling level sensor which detects the pressure and/or filling level of the tank (1).

7. A method of operating the device according to claim 1, characterized by the features the adsorption filter (4) is regenerated only after a determination of the loading state by the circulation flow, on initiation of the regeneration, the loading state of the adsorption filter determined previously is taken into account by the engine control to prevent a disturbance in the exhaust gas state due to the purging air, the loading of the purging air is determined by the sensor during the entire period of regeneration and is taken into account as an influencing variable by the engine control.

8. The method according to claim 7, characterized in that the degree of tank filling is at least a trigger and/or one of various prerequisites for inducing backwashing of the adsorption filter.

* * * * *